US006230844B1

(12) United States Patent
Latorre

(10) Patent No.: US 6,230,844 B1
(45) Date of Patent: May 15, 2001

(54) ROPE TRACTION ELEVATOR

(75) Inventor: Carlos Latorre, Zaragoza (ES)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/351,843

(22) Filed: Jul. 13, 1999

(30) Foreign Application Priority Data

Jul. 13, 1998 (EP) ..... 98810662

(51) Int. Cl.[7] ..... B66B 11/08

(52) U.S. Cl. ..... 187/254; 187/350; 254/343; 254/362

(58) Field of Search ..... 187/250, 251, 187/254, 256, 259, 261, 350; 254/343, 362, 378

(56) References Cited

U.S. PATENT DOCUMENTS

| | | | | |
|---|---|---|---|---|
| Re. 34,989 | * | 7/1995 | Struhs et al. | 348/151 |
| 3,690,409 | * | 9/1972 | Brauss | 187/261 |
| 3,804,460 | * | 4/1974 | Leffler | 297/330 |
| 4,026,552 | * | 5/1977 | Schmid | 273/49 |
| 4,569,423 | * | 2/1986 | Hirano | 254/343 |
| 4,688,660 | * | 8/1987 | Kaneko | 254/343 |
| 4,807,723 | * | 2/1989 | Salmon et al. | 187/254 |
| 4,884,783 | * | 12/1989 | McIntosh et al. | 254/343 |
| 4,960,186 | * | 10/1990 | Honda | 187/254 |
| 5,226,508 | * | 7/1993 | Ericson et al. | 187/254 |
| 5,233,139 | * | 8/1993 | Hofmann | 187/251 |
| 5,361,024 | * | 11/1994 | Wisner et al. | 318/588 |
| 5,477,958 | * | 12/1995 | Buhren et al. | 187/751 |
| 5,572,930 | * | 11/1996 | Hein | 187/250 |
| 5,669,469 | * | 9/1997 | Ericson et al. | 187/254 |
| 5,881,843 | * | 3/1999 | O'Donnell et al. | 187/254 |
| 5,890,564 | * | 4/1999 | Olsen et al. | 187/250 |

FOREIGN PATENT DOCUMENTS

| | | | | |
|---|---|---|---|---|
| 2049422 | * | 2/1993 | (CA) | 187/350 |
| 1 918 376 | | 6/1965 | (DE) . | |
| 37 37 773 | | 6/1988 | (DE) . | |
| 2199109 | * | 6/1988 | (DE) | 187/254 |
| 076 420 | | 5/1983 | (EP) . | |
| 78875 | * | 5/1983 | (EP) | 187/254 |
| 202 525 | | 11/1986 | (EP) . | |
| 445521 | * | 9/1991 | (EP) | 187/254 |
| 403223081 | * | 10/1991 | (JP) | 187/254 |
| 405078054 | * | 3/1993 | (JP) | 187/251 |
| 405147851 | * | 6/1993 | (JP) | 187/350 |
| 406016363 | * | 1/1994 | (JP) | 187/254 |
| 1572970 | * | 6/1990 | (SU) | 187/254 |

* cited by examiner

*Primary Examiner*—Robert P. Olszewski
*Assistant Examiner*—Paul T. Chin
(74) *Attorney, Agent, or Firm*—Cohen, Pontani, Lieberman & Pavane

(57) ABSTRACT

An elevator drive for a rope traction elevator, which is intended for installation in an elevator hoistway, includes of a gear with a traction sheave, a motor in an upright position on top of the gear, a brake and suspension elements which are slung over the traction sheave and provide vertical motion for an elevator car with a counterweight. The motor and the gear are inclined at an angle to the vertical. With this slightly tilted arrangement no part of the motor extends beyond the horizontal boundary of the gear. Furthermore, the brake is a part of the gear and non-detachably fastened to it, which makes it possible to mount the motor on the gear, and to dismount it therefrom, without difficulty.

19 Claims, 3 Drawing Sheets

ROPE TRACTION ELEVATOR

BACKGROUND OF THE INVENTION

1. Field of the Invention

The present invention relates to a rope traction elevator with an elevator drive, and comprises a gear with a traction sheave, a motor, a brake, and suspension elements which pass over the traction sheave to provide vertical motion to an elevator car, preferably with a counterweight. The motor of the elevator drive is in an upright position.

2. Discussion of the Prior Art

An elevator drive of the type mentioned is known from German reference DE 37 37 773 C2. The purpose of this construction is to make it easy to assemble the gear, and to permit rapid mounting and dismounting of the motor, while keeping the bearings aligned during the process. The motor, which is in an upright position on top of the gear, has a drum brake at its upper end.

With today's high level of thermal load on motor windings, the occurrence of a fault in the windings due to an overload appears to be more probable than a mechanical defect in the gear. If a defective motor has to be replaced, the brake on top of the motor also has to be removed together with the defective motor. A prerequisite for this operation is that the car and counterweight must first be secured against unbraked movement, for example by applying clamps to the ropes and/or supporting the counterweight in the hoistway. This procedure is time-consuming and carries the risk of accidents.

The German utility model 1 918 376 discloses an elevator drive consisting of a worm gear and a motor which is also in an upright position, but in which the motor is an external rotor motor and whose cylindrical external surface simultaneously serves as a brake drum. With this drive the brake also has to be removed when the motor is replaced, which gives rise to the same disadvantageous effect as already described above. Furthermore, the large gyrating mass resulting from the external rotor principle can have a negative effect on the acceleration and deceleration of the elevator car.

In both of the drives mentioned, the small size of the motors in relation to the size of the gear leads to the conclusion that these drives are designed only for relatively low power output. If a motor for the medium power range is used which has a higher power output and is therefore larger, the horizontal dimensions of the motor may be greater than those of the gear base, which has negative consequences for the range of possible layouts.

SUMMARY OF THE INVENTION

The object of the present invention is therefore to create an elevator drive whose motor and gear cases have narrow dimensions, i.e. in at least one horizontal dimension they are narrow enough for the drive to be located in the side of the hoistway in such a manner as to save space, but at the same time using a normal shape of motor. Moreover, it must be possible to replace the motor rapidly and easily without the disadvantages mentioned above.

Pursuant to this object, and others which will become apparent hereafter, one aspect of the present invention resides in the elevator drive, including the upright motor attached to it, being slightly tilted so that a vertical projection of the motor from above lies within the horizontal boundary of the gear. Another object is to achieve this without complex structural modifications.

The inclination of the axis of the motor and gear is achieved by the mounting feet of the gear being in an inclined plane relative to the base of the gear.

The mechanical brake is positioned between the motor and the gear and does not have to be removed if the motor is replaced. As a result, movement of the drive and traction sheave after the motor has been removed is prevented by the closed brake, and no additional measures are needed to hold the elevator in position.

The mechanical brake is constructed as an integral part of the gear and is contained in a part of the gear case. The part of the gear case containing the brake is constructed as a flange collar, which faces upwards and has a flange plate to receive the motor, and which together with the lower part of the gear is constructed as a single-piece casting.

The vertical cross-section of the gear case, which optimally is oval in shape for high strength and rigidity, whose curves are constructed from several different radii, and whose height is greater than its width, makes it possible for the gear case to have thin walls and compact dimensions in the horizontal direction.

By positioning a flywheel above the motor it is possible to use a flywheel which projects beyond the cross-section of the motor case without exceeding the dimensions available for installation.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matted in which there are illustrated and described preferred embodiments of the invention.

DETAILED DESCRIPTION OF THE PREFERRED EMBODIMENTS

Figure 1:
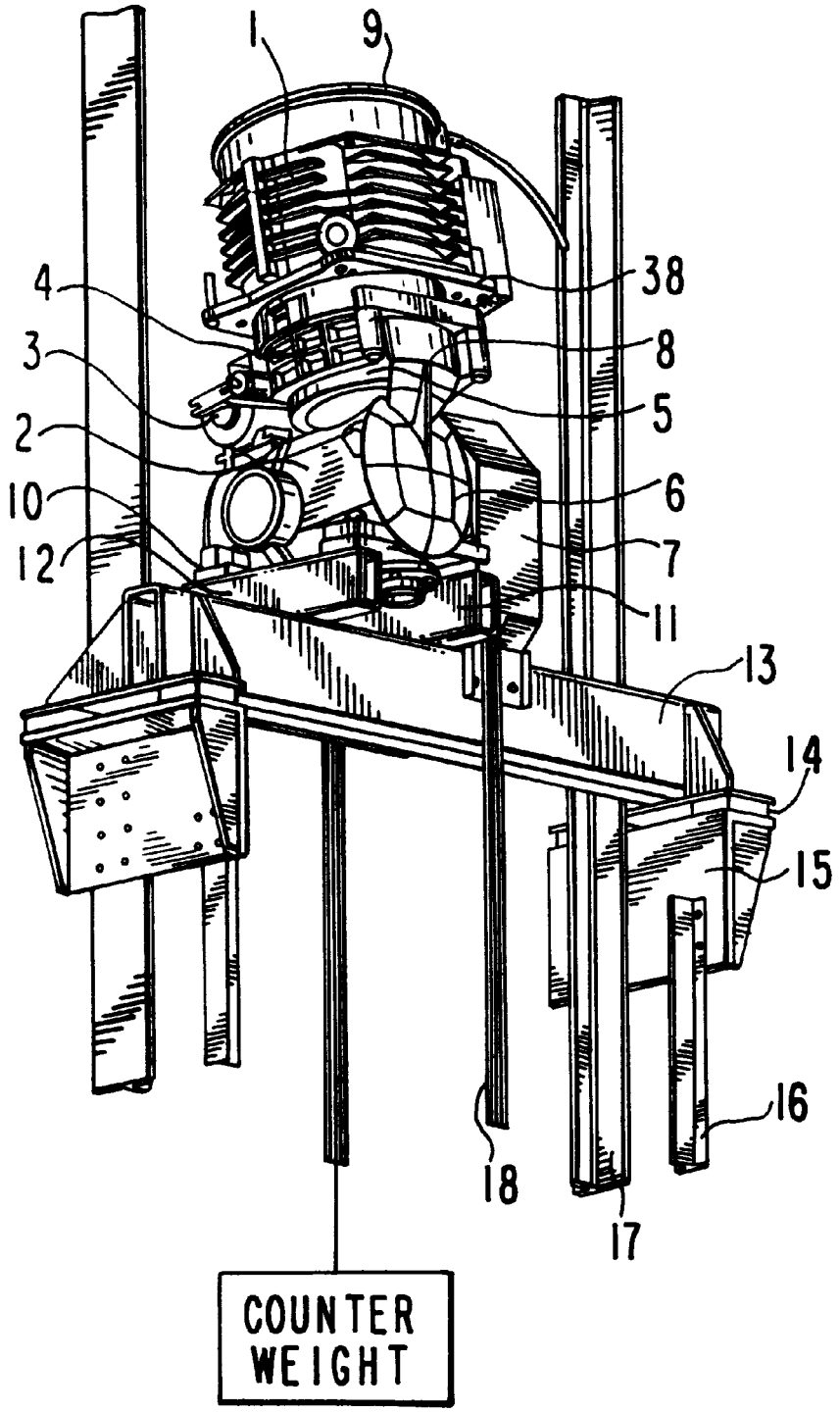
FIG. 1: is a three-dimensional view of the elevator drive and its position in the hoistway.

FIG. 1 shows an example of the elevator drive according to the invention installed in a hoistway. The elevator drive consists of a gear 2 with a flange collar 8, which faces upwards and has in its side openings containing the mechanical brake, and a motor 1 mounted above the brake and having a flywheel 9. The mechanical brake consists of a brake drum 5, a brake magnet 3, and brake shoes 4. Through openings in the sides of the flange collar 8, the brake shoes 4 act from outside on the brake drum 5. The flange collar 8 is closed on its upper side with a flange plate 38 onto which the motor 1 is fastened with screws. The gear 2 is detachably fastened by means of mounting feet 10 at the sides to horizontal supports 11, 12 for the gear. A traction sheave 6 with a cover 7 is located to the side of the gear 2. Suspension elements 18 are slung over the traction sheave 6 and support a car, not shown and a counterweight. The gear supports 11, 12 are positioned on a horizontal transverse beam 13 which is itself connected via elastic supporting pads 14 and a bracket 15 to the car guide rails 17 and the counterweight guide rails 16. The parts 11–14 thereby form a supporting framework for the elevator drive machine. It can also be seen from FIG. 1 that the motor 1 is not exactly vertical, but at a slight inclination to the vertical and tilting towards the back.

Further details of the elevator drive are explained below with reference to FIG. 2. The active parts of the gear, a worm 20 and a worm wheel 27 which is enmeshed with the worm 20, are installed in an enclosed, oil tight and approximately rectangular hollow space in the lower part of the gear case 28. The worm 20 is part of a motor/worm shaft 19 which is held radially at its lower end in a fixed bearing 30 and axially in the gear case 28, and is guided by a movable bearing 29 at the point where the shaft 19 emerges from this part of the gear case 28. The worm wheel 27 is connected to a traction sheave shaft 35 in such a way that they cannot rotate relative to each other. This part of the gear case 28 is closed at the right-hand side with a gear cover 31, has an oil drainage screw 32 at its lowest point, and is filled with gear oil 34 up to the level 33. Together with the upward facing flange collar 8 and flange plate 38, this part of the gear case 28 is constructed as a single-piece cast case.

On a flat part of the right-hand side of the gear case 28, and adjacent to the flange collar 8, the brake magnet 3 is mounted. A manual brake release lever for opening the brake by hand is shown in the drawing as number 37. The brake drum 5, which is located above the movable bearing 29 and inside the flange collar 8, is non-detachably fastened to the motor/worm shaft 19. A motor case 24 of the motor 1 is detachably fastened to the flange plate 38, preferably by means of screws. The motor case 24 surrounds a laminated stator core 23 with a stator winding 22 whose winding ends project at the lower end into the flange collar 8. A rotor 21 with a laminated core and a short-circuited winding of a type typical for alternating current motors is located on the motor/worm shaft 19 adjacent to the stator laminations 23.

A fan wheel 25 and the flywheel 9 are attached to the motor/worm shaft 19 close to its upper end in such a way that they cannot turn relative to it and are axially secured with a screw 40. Number 36 shows a bevel gear ring which is screwed onto the flywheel 9. The air ventilation opening on the circumference of the fan wheel 25 is covered with a ventilation grille 26. The angle β is the angle of inclination of the motor axis 100 relative to a vertical axis 101. The angle of inclination β can be any number of angular degrees that allows the advantages previously mentioned to be obtained. In the example shown, the angle β is approximately 10°. The plane of the bottom of the gear case, shown as number 39, is inclined by the same angle β to the horizontal plane.

Figure 3:
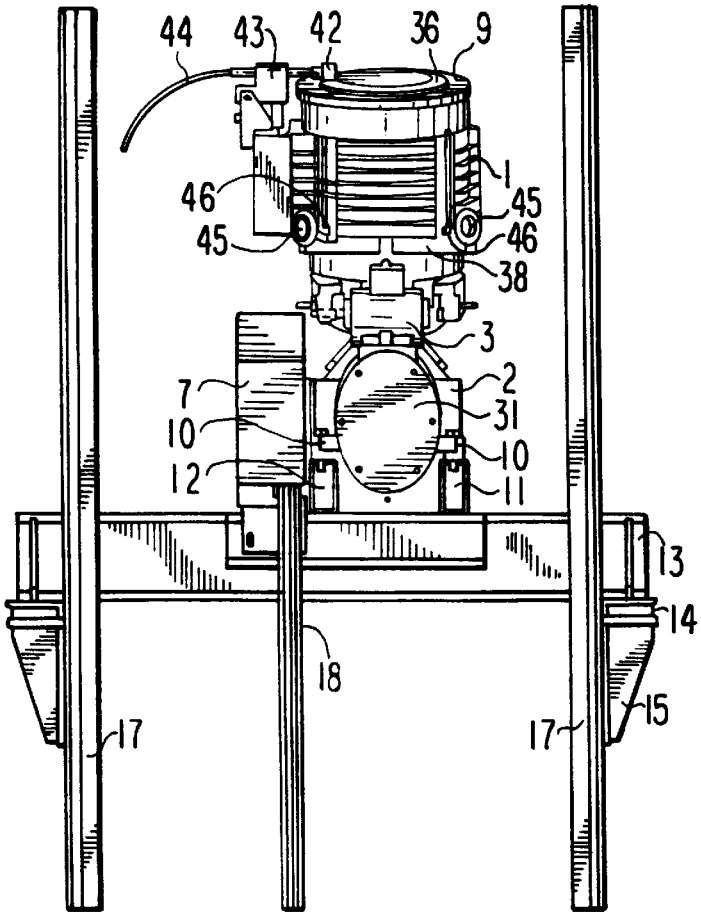
FIG. 3: is a front elevation.

In FIG. 3 the front elevation shows additional parts of a manually operated evacuation device consisting of a manual operation shaft 44, a pivoting clutch mechanism 43, a bevel gear pinion 42, and the bevel gear ring 36 mentioned above. The oval-like shape of the gear with the gear cover 31 is also visible.

Figure 4:
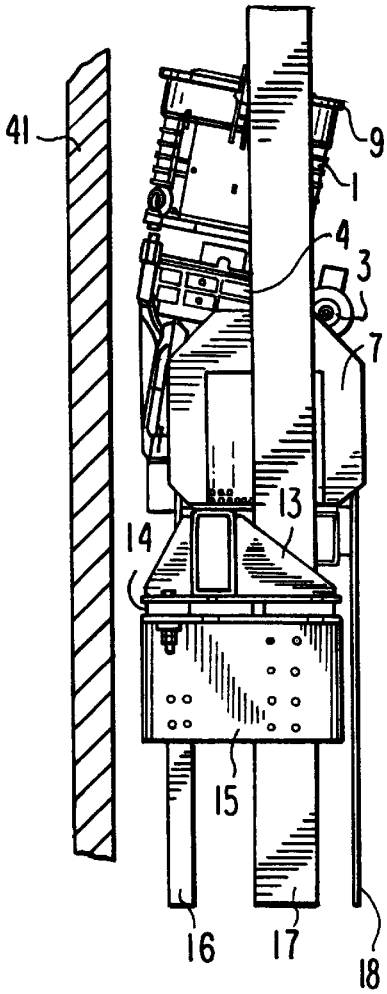
FIG. 4: is a side elevation.

FIG. 4 clearly shows the advantage of the axis of the motor 1 being inclined at an angle β to the vertical. Because the motor 1 does not project anywhere along its length beyond the base of the gear case, this elevator drive can be placed correspondingly close to a hoistway wall 41, as the extent perpendicular to the plane of the guide rails, and therefore the horizontal dimension of the drive between the hoistway wall and the path of the car, is correspondingly narrow. Furthermore, an elevator car having suspension ropes fastened to its lower part can travel along the car guide rails 17 upwards and to the right of the elevator drive as depicted in FIG. 4 and past the motor 1 of the elevator drive.

Figure 2:
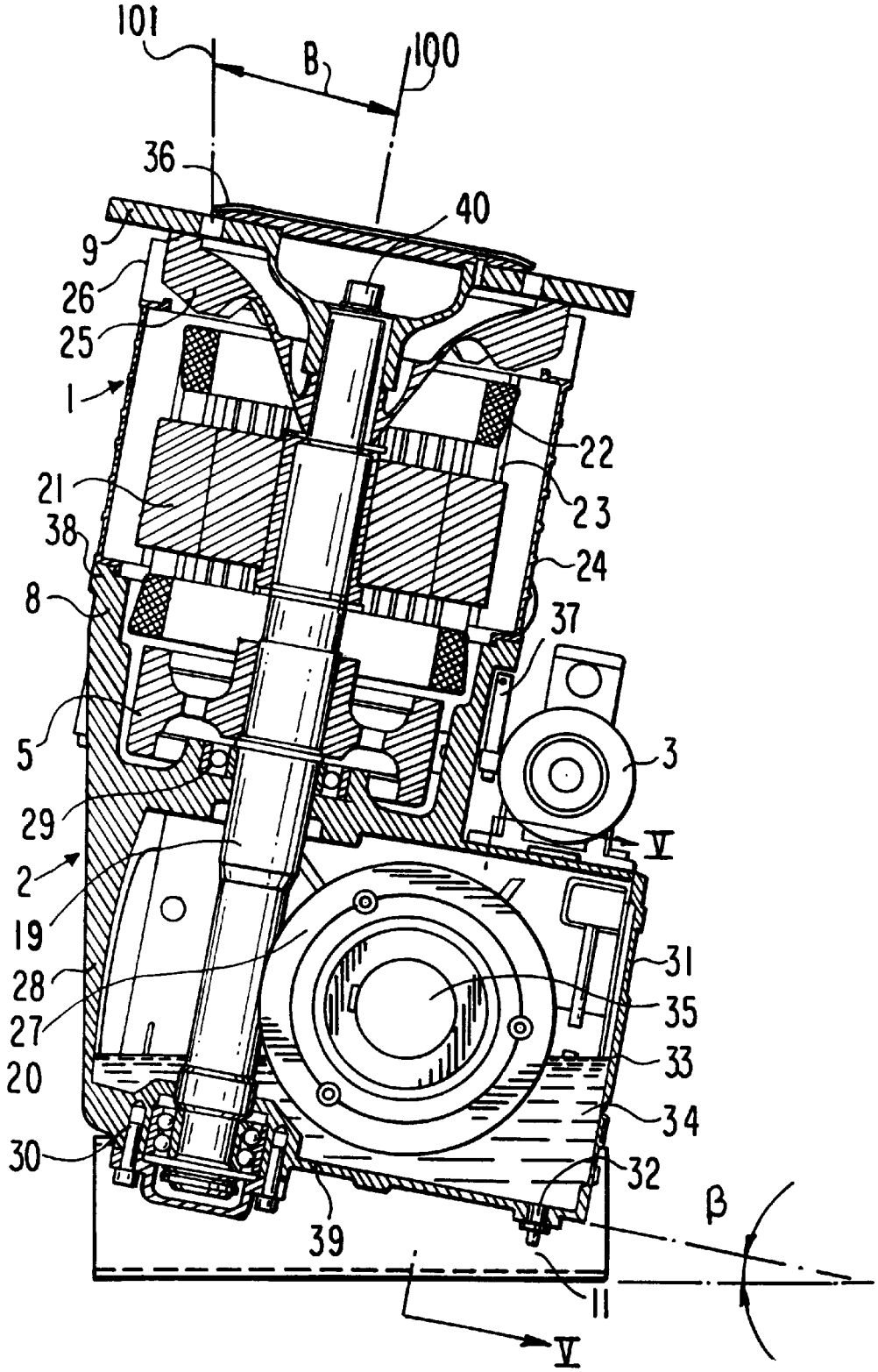
FIG. 2: is a vertical cross-section of the elevator drive shown in FIG. 1.
Figure 5:
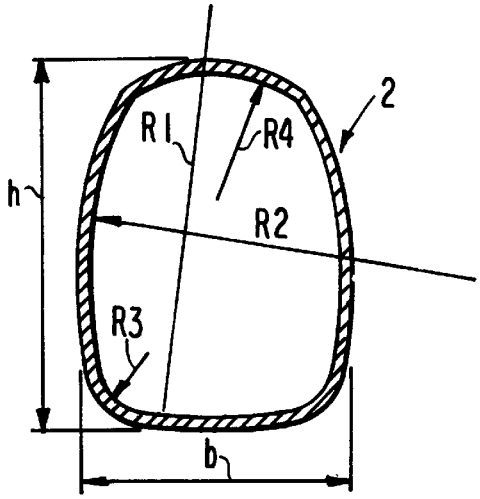
FIG. 5: is a cross-section of the gear case along the plane V—V in FIG. 2.

FIG. 5 shows a cross-section of the gear case 28 on the plane cutting the gear case 28 marked in FIG. 2. FIG. 5 shows an ideal contour for the case wall in relation to strength and torsional rigidity for this gear 2. The height h of the external case contour is greater than the width b. In the example shown, the contour of the gear case, which was calculated using the method of finite elements, has four different radii R1–R4 along its perimeter, although the number of radii which flow into each other can be greater or less than four. This results in the wall of the gear case having a cross-section with a shape similar to an oval. The case wall can also be kept relatively thin, which also has a positive effect on the external dimensions and the weight of the gear 2.

The detailed manner of constructing the elevator drive is not limited to the example shown. The mechanical brake, for example, can also be implemented as a disk brake with the corresponding mounting parts.

The size and shape of the motor 1 can deviate from the embodiment shown.

The invention is not limited by the embodiments described above which are presented as examples only but can be modified in various ways within the scope of protection defined by the appended patent claims.

I claim:

1. A rope traction elevator, comprising an elevator drive having:

a gear case;

a worm gear arranged in the gear case;

a worm wheel arranged in the gear case so as to engage with the worm gear, the worm wheel being mounted on an output-drive shaft so as to rotate with the drive shaft;

a motor/worm shaft connected to the worm gear so as to project out of the gear case;

a motor having a motor housing, a rotor, and a stator flange-connected to the gear case; and a brake arranged between the motor and the gear case gearing wherein the brake is arranged in the gear case.

2. A rope traction elevator with an elevator drive as defined in claim 1, wherein the gear case has a flanged collar that connects the gear case and the motor housing to the stator, and accommodates the brake.

3. A rope traction elevator with an elevator drive as defined in claim 2, wherein the flanged collar forms a flange plate configured to accommodate the motor housing.

4. A rope traction elevator with an elevator drive as defined in claim 1, wherein the brake includes a brake magnet arranged so that a vertical projection from the brake magnet lies within a vertical projection from the gear case.

5. A rope traction elevator with an elevator drive as defined in claim 4, wherein the brake magnet is attached to the gear case.

6. A rope traction elevator with an elevator drive as defined in claim 3, wherein the gear case, the flanged collar and the flange plate are formed as a single cast housing.

7. A rope traction elevator with an elevator drive as defined in claim 2, wherein the brake includes brake shoes, the flanged collar having sides with openings that accommodate the brake shoes.

8. A rope traction elevator with an elevator drive as defined in claim 1, wherein the gear case has a width and a height greater than the width, the gear case being configured to have an oval cross-section.

9. A rope traction elevator comprising an elevator drive having:

a gear case;

a motor coupled to the gear case and having a rotational axis;

a horizontal output-drive shaft arranged in the gear case;

a driving sheave connected to the output-drive shaft so that the sheave and the shaft rotate together, the motor axis being arranged parallel to a plane of the driving sheave and at an acute angle to vertical; and a support structure, the horizontal output-drive shaft being supported on the support structure via the gear case.

10. A rope traction elevator with an elevator drive according to claim 9, wherein the horizontal output-drive shaft is mounted in a floating manner in the gear case.

11. A rope traction elevator with an elevator drive according to claim 9, and further comprising mounting feet provided on the gear case.

12. A rope traction elevator with an elevator drive according to claim 11, wherein the mounting feet are configured to provide a horizontal standing surface for the gear case.

13. A rope traction elevator with an elevator drive according to claim 11, wherein the mounting feet are integral with the gear case.

14. A rope traction elevator with an elevator drive according to claim 9, and further comprising an input-drive shaft arranged in the gear case so as to be in operative communication with the output-drive shaft, the gear case having a flanged collar in a region of the input-drive shaft, the motor including a housing connected to the gear case by the flanged collar, the input-drive shaft being at a right angle to the horizontal output-drive shaft.

15. A rope traction elevator comprising an elevator drive having:

a gearing having a gear case, an input-drive shaft and a horizontal output-drive shaft whose axes cross;

a driving sheave connected to the output-drive shaft; and a motor in driving connection with the input-drive shaft, the motor including a motor housing connected to the gear case so that an axis of the motor is arranged axially relative to the input-drive shaft and parallel to a plane of the driving sheave at an acute angle to vertical, the gear case being configured so as not to project horizontally beyond a vertical projection line of the motor housing at least on an input-drive shaft side of the gear case.

16. A rope traction elevator with an elevator drive according to claim 15, wherein the gear case is configured so as to have at least one boundary that runs substantially vertically in a plane at a right angle to the driving sheave plane.

17. A rope traction elevator with an elevator drive according to claim 15, wherein the gear case has a flanged collar in a region of the input-drive shaft which is at a right angle to the horizontal output-drive shaft, the motor housing being connected to the gear case by the flanged collar.

18. A rope traction elevator with an elevator drive according to claim 15, wherein the input-drive shaft is common to both the motor and the gearing so that torque is transmitted via the common input drive shaft.

19. A rope traction elevator with an elevator drive according to claim 15, and further comprising a worm gear connected to the input drive shaft and a worm wheel connected to the output-drive shaft, the worm gear engaging the worm wheel at a right angle.

* * * * *